US005513435A

United States Patent [19]

Benjamin

[11] Patent Number: 5,513,435

[45] Date of Patent: May 7, 1996

[54] NAIL FIN REMOVAL TOOL

[76] Inventor: Larry Benjamin, 12105 Klondon Dr., Yakima, Wash. 98908

[21] Appl. No.: 348,448

[22] Filed: Dec. 2, 1994

[51] Int. Cl.[6] ..... B26B 15/00

[52] U.S. Cl. ..... 30/264; 30/206; 30/265

[58] Field of Search ..... 30/264, 265, 206, 30/228, 180, 187; 29/243.37

[56] References Cited

U.S. PATENT DOCUMENTS 2,642,658 6/1953 Johnson ..... 30/264

4,366,620 1/1983 McClure ..... 30/264

*Primary Examiner*—Douglas D. Watts

*Attorney, Agent, or Firm*—Stratton Ballew

[57] ABSTRACT

A tool for removing nail fins from vinyl window frames comprising either a pneumatic wrench or an electric hand drill driving a tool having a slot into which cutter wheels project along with toothed rings above the cutter wheels. The toothed rings move the tool along the nail fin while the cutter wheels cut the nail fin from the frame.

14 Claims, 10 Drawing Sheets

NAIL FIN REMOVAL TOOL

BACKGROUND OF THE INVENTION

Vinyl window frames, when used in new construction, have one or two nail fins extending outward perpendicularly from the frame. When used in existing construction, however, the nail fins must be removed before installation.

I was watching an employee in the process of removing a nail fin from a vinyl window frame when the scoring knife slipped, and he cut his forearm, requiring a trip to the hospital emergency room to get his arm stitched.

Additionally, there are carpal tunnel problems due to heavy downward pressure on the scoring knife, which adds to the time loss to the employer and the employee.

Another alternative is to use a table saw to cut the fin off. The use of a table saw is a potential hazard, and always requires extra time to clean chips from the extrusions.

In removal of the nail fin by scoring, the worker has to score the fin at the frame, and push down and pull up on the fin to fatigue it to break it off. It takes a strong person to do this all day.

The nail fin removal tool I have developed eliminates accidental injuries from scoring knives. The necessity of scoring the fin adjacent to the frame body so that the fin can be worked back and forth to break it off is eliminated.

The nail fin removal tool procedure is:

1. Line up tool on fin.
2. Apply drive power.
3. Guide tool.
4. Take off fin.

The advantages of the nail fin removal tool are:

1. The tool eliminates knife cuts.
2. Use of the tool greatly reduces wrist fatigue.
3. Accidents will be avoided when this tool is used, and will save the employer and employee many hours of lost time and medical expenses.

BRIEF DESCRIPTION OF THE INVENTION

The nail fin removal tool may be driven by means of a pneumatic wrench, as in FIG., 1, or an electric hand drill, as in FIG. 7. As can be seen in FIGS. 2, 3 and 4, within the tool are two parallel shafts. The shaft driven by the pneumatic wrench has a gear near the driven end. That gear engages with a similar gear on the second shaft. At the opposite end of each shaft is a cutter wheel. As a part of the cutter wheel, but separated from the cutter, is a toothed ring. As can be seen in FIG. 2, the toothed rings are spaced apart a sufficient distance to allow the teeth to engage the nail fin, and move the tool along the length of the fin.

DETAILED DESCRIPTION OF THE INVENTION

Figure 1:
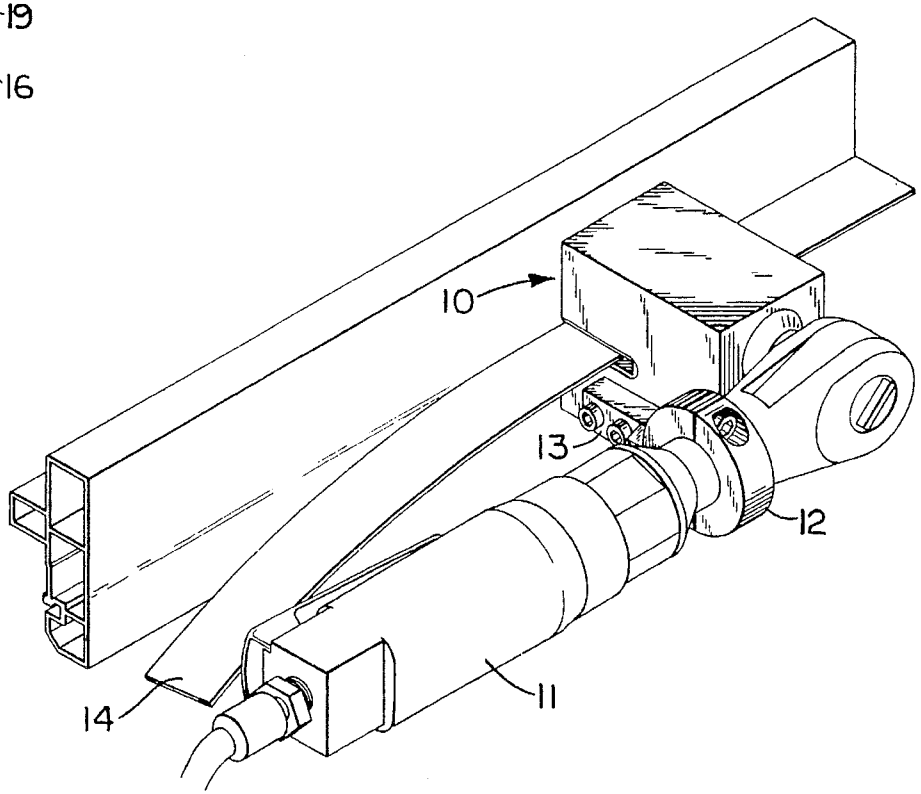
FIG. 1 shows a first model of the tool driven by a pneumatic wrench in the act of removing a nail fin.
Figure 2:
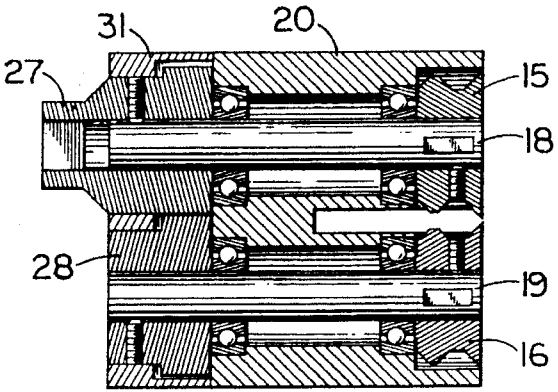
FIG. 2 is a cross-section of the first model of the tool.

FIG. 1 shows the first model of the tool 10 driven by pneumatic wrench 11. Wrench 11 is attached to tool 10 by circular split yoke 12, to which is welded bar 13. Bar 13 is screwed to tool 10. The tool 10 is in the act of removing nail fin 14.

Figure 3:
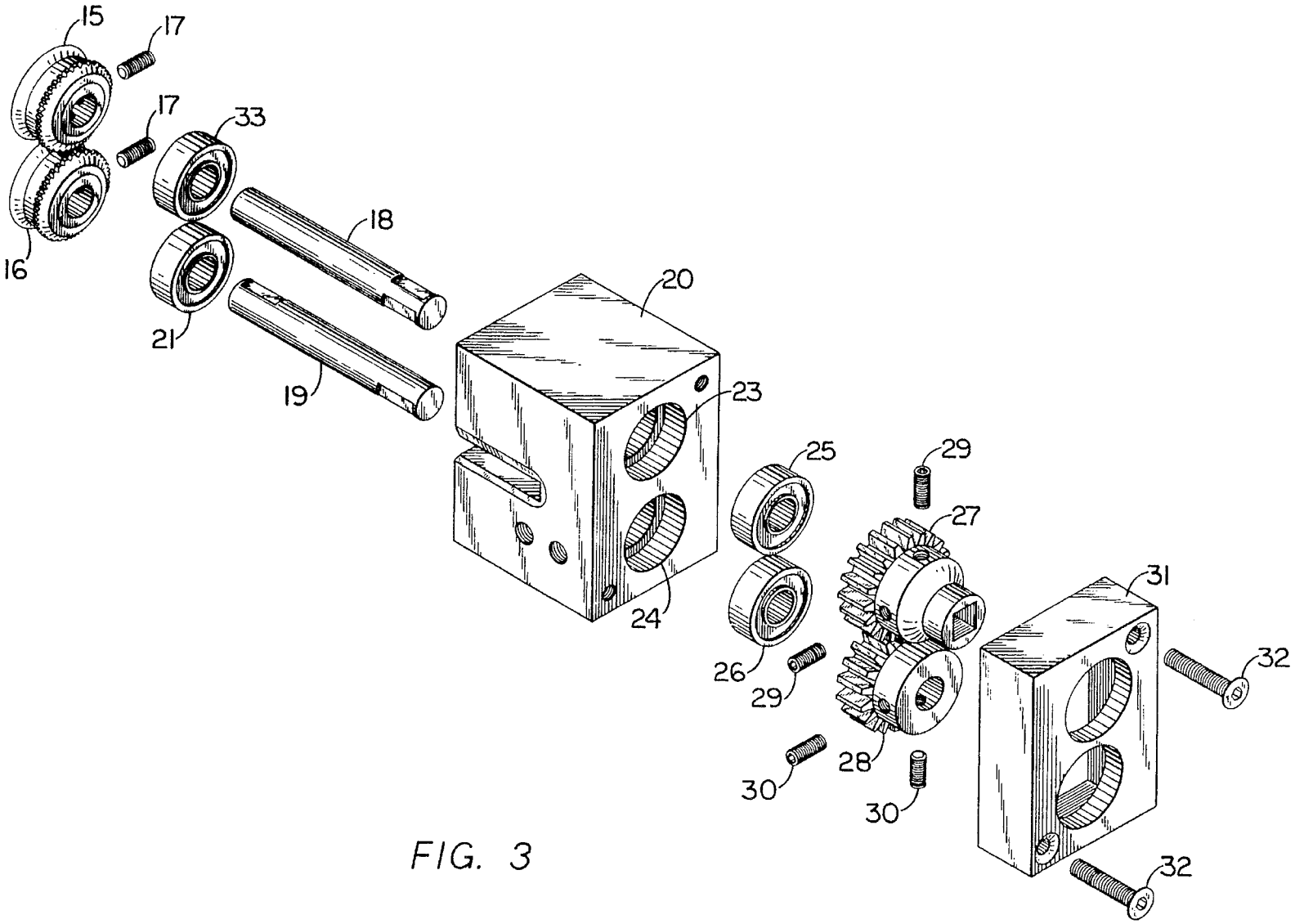
FIG. 3 is an exploded view of the first model of the tool viewed from the driven end.
Figure 4:
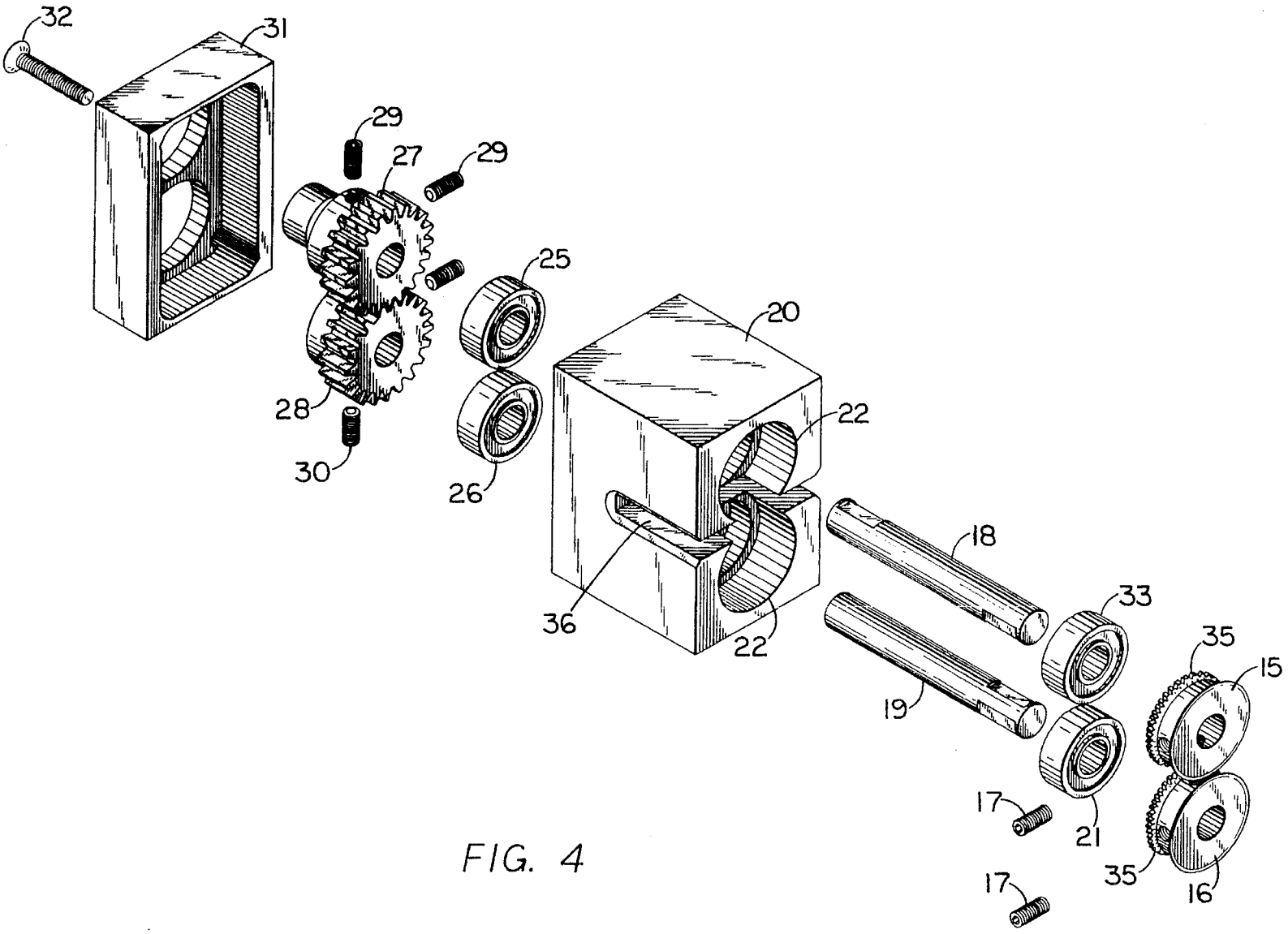
FIG. 4 is an exploded view of the first model of the tool viewed from the cutter end.
Figure 6:
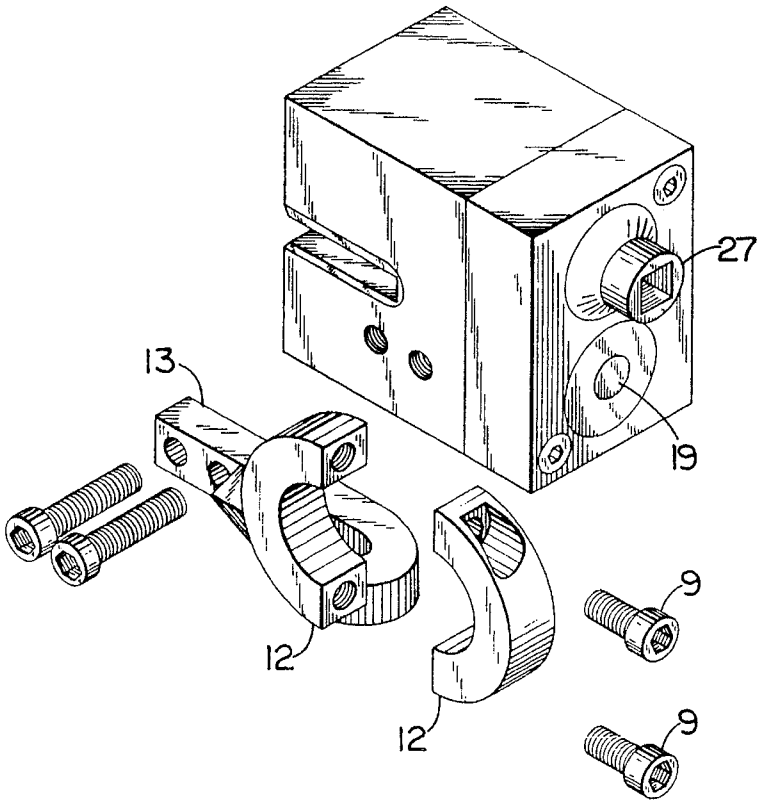
FIG. 6 is a view of the first model of the tool viewed from the driven end and showing the attachment for the pneumatic wrench.
Figure 5:
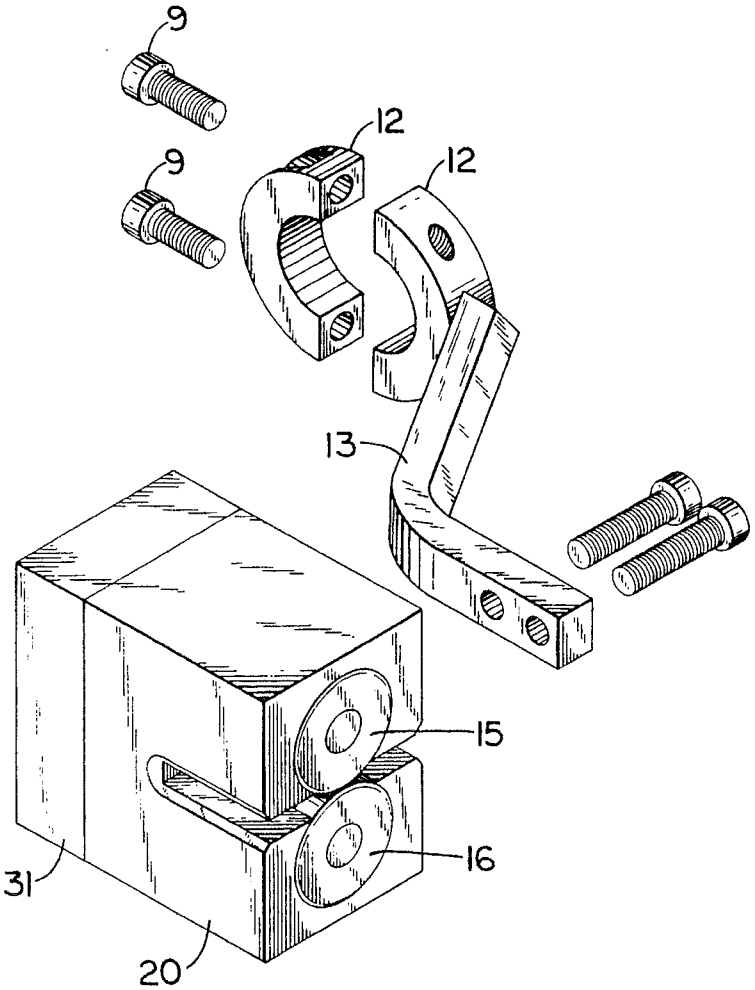
FIG. 5 is a view of the first model of the tool viewed from the cutter end and showing the attachment for the pneumatic wrench.
Figure 7:
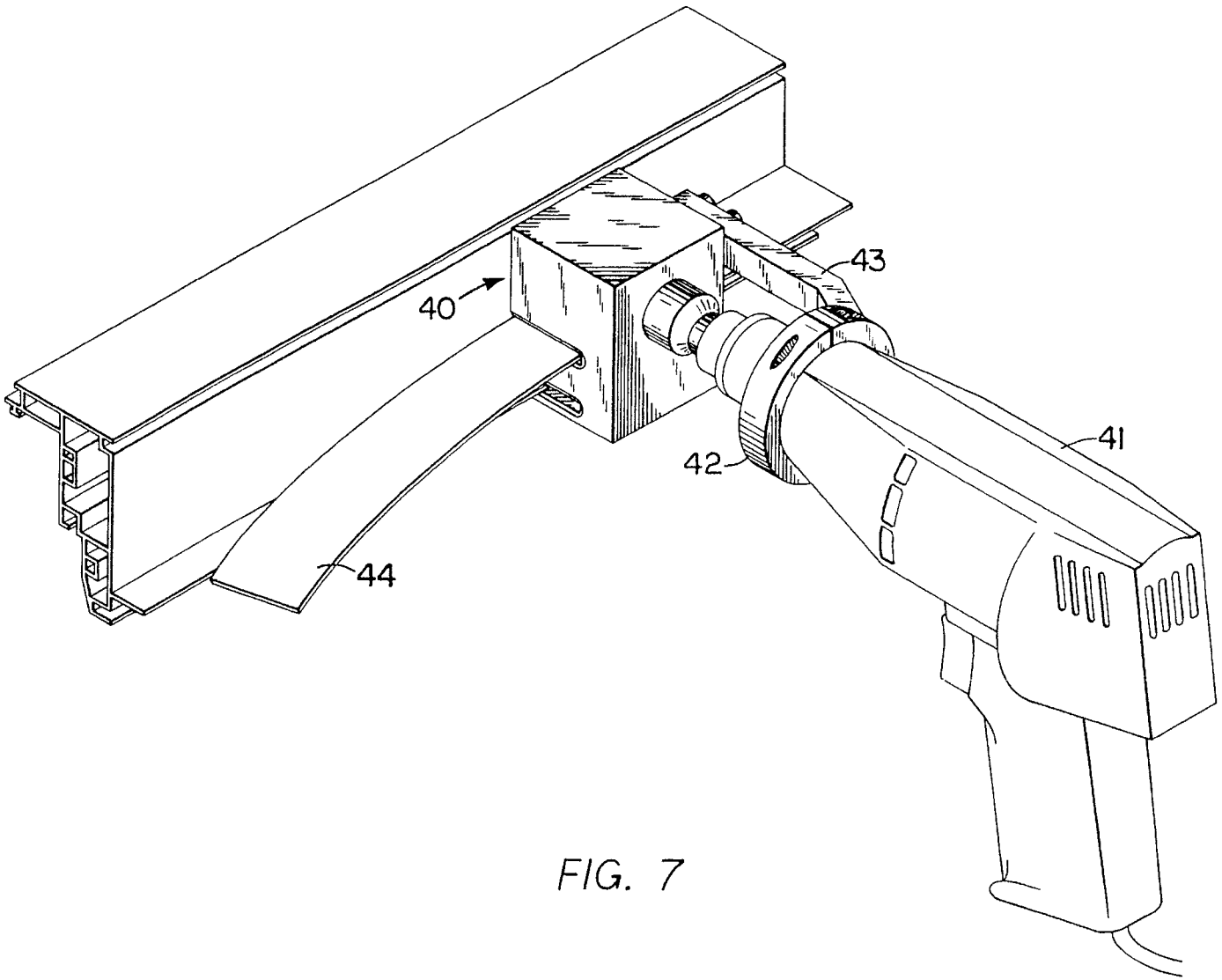
FIG. 7 shows a second model of the tool driven by an electric hand drill in the act of removing a nail fin.
Figure 8:
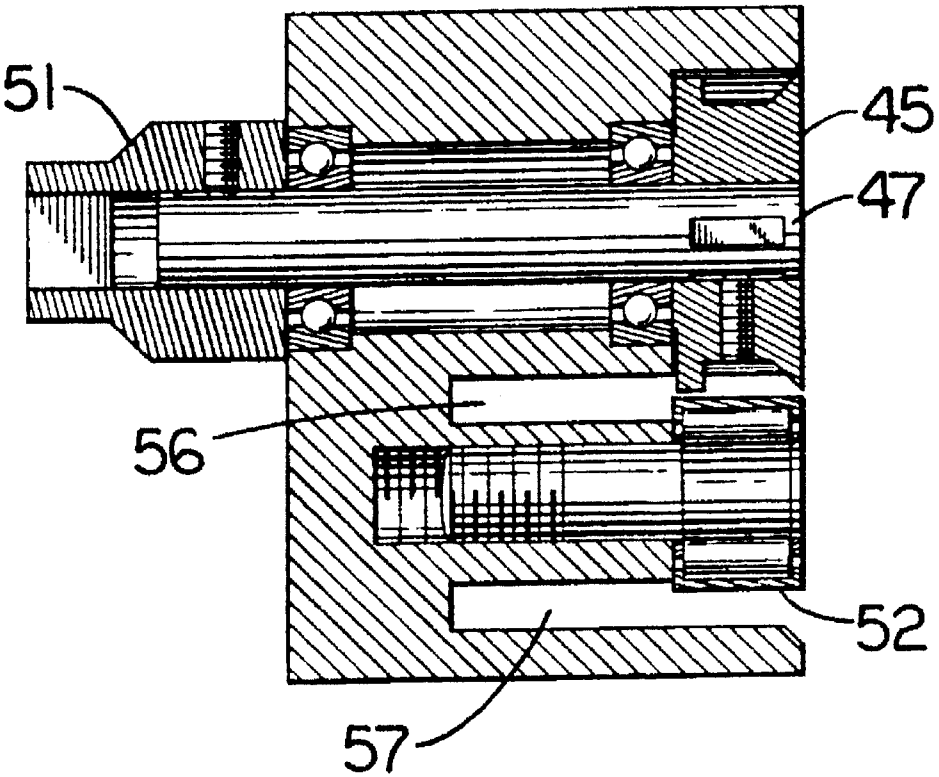
FIG. 8 is a cross-section of the second model of the tool.
Figure 9:
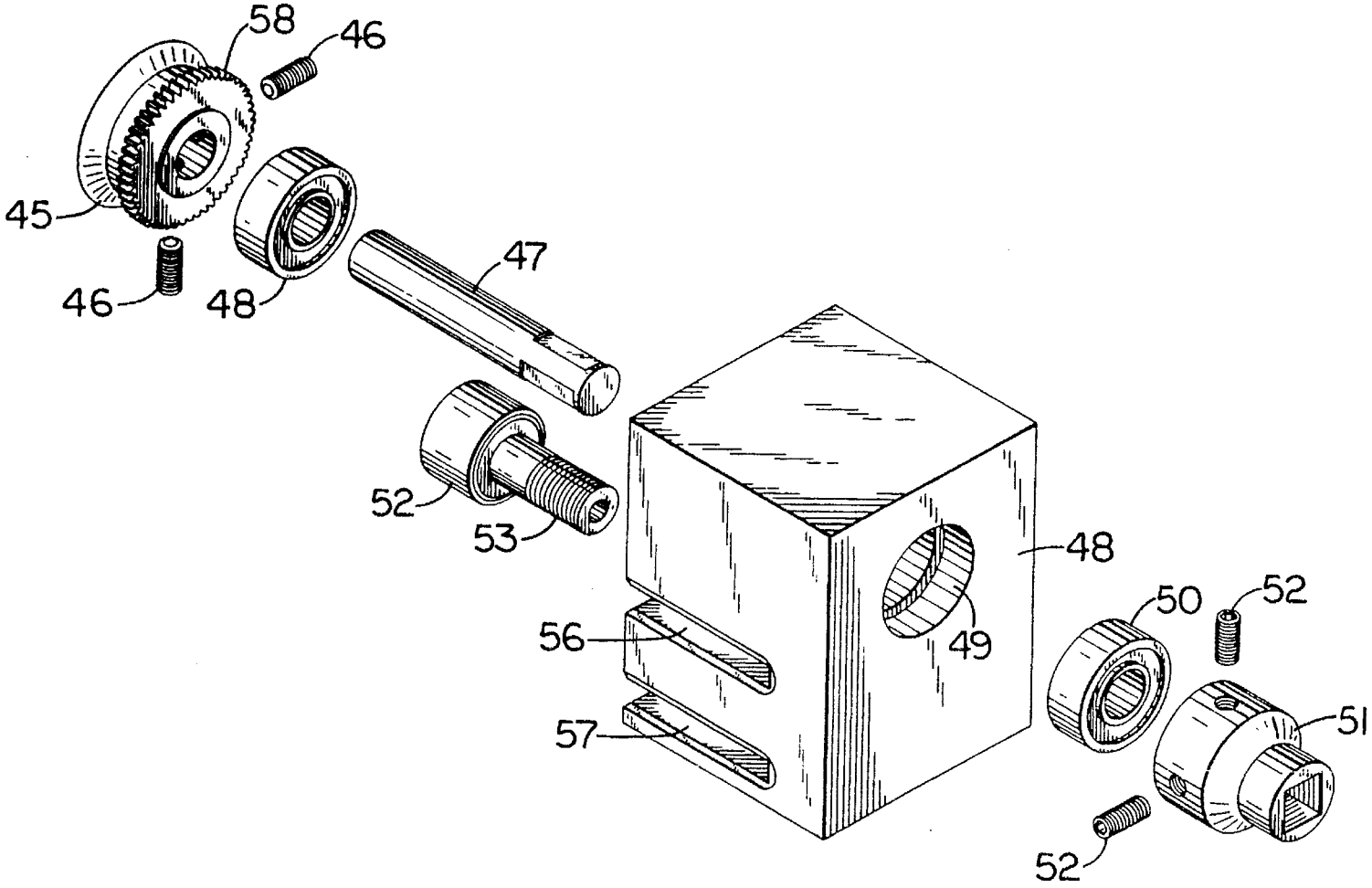
FIG. 9 is an exploded view of the second model of the tool viewed from the driven end.
Figure 11:
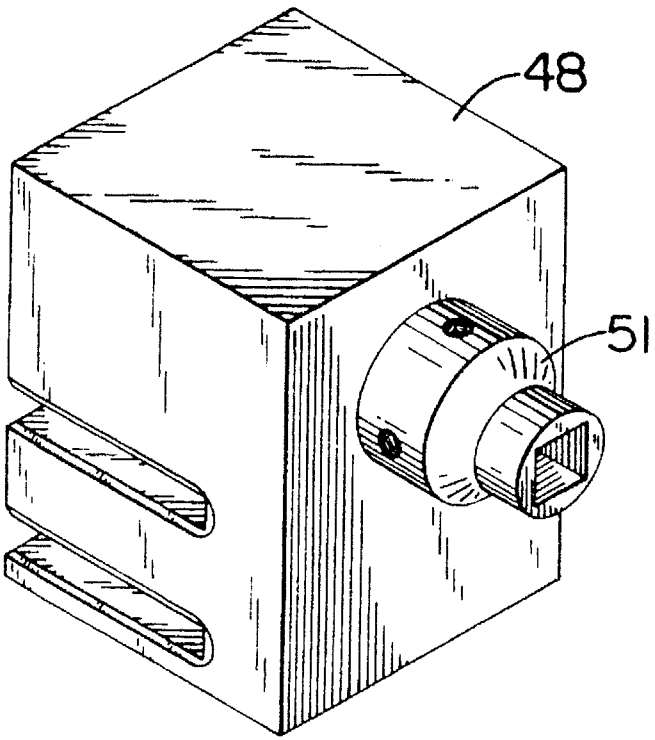
FIG. 11 is a view of the assembled second model of the tool viewed from the driven end.
Figure 10:
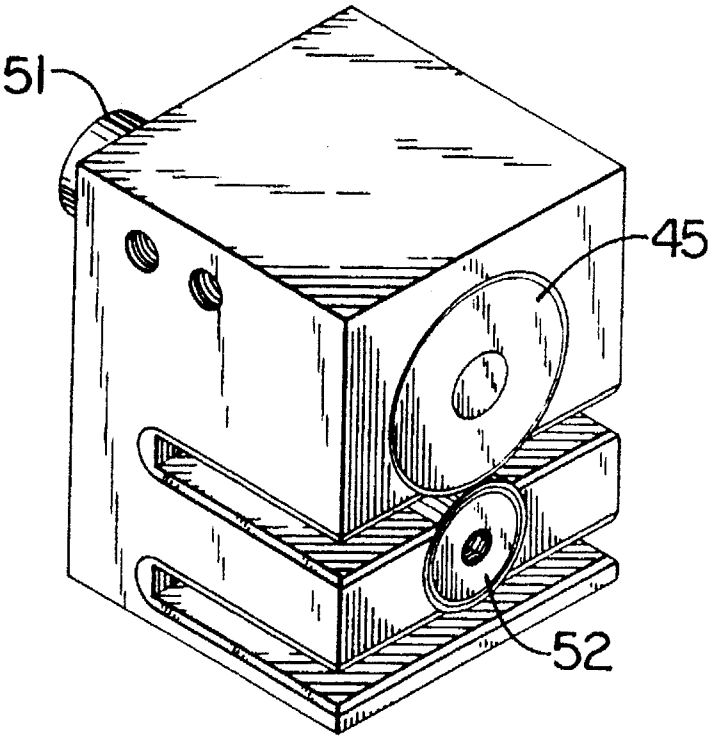
FIG. 10 is a view of the assembled second model of the tool viewed from the cutter end.

Referring to FIGS. 3 and 4, the method of assembly is as follows. Cutter wheel 15 is placed at the end of shaft 18 and held in place by a set screw 17. Cutter wheel 16 is placed on shaft 19 and held in place by a set screw 17. The ends of shafts 18 and 19 are co-planar with the cutting edges of cutter wheels 15 and 16. Ball bearing 33 is pressed on to shaft 18, and ball bearing 21 is pressed on to shaft 19. Cutter wheel 15 assembly is then pressed in to recess 22 in cutter housing 20. Cutter wheel 16 assembly is then pressed in to recess 22 in cutter housing 20. Shaft 18 projects through opening 23 in cutter housing 20, and shaft 19 projects through opening 24. Ball bearing 25 is pressed onto shaft 18 and occupies opening 23. Ball bearing 26 is pressed on to shaft 19 and occupies opening 24. Gear 27 is placed on the end of shaft 18 and held in place by set screws 29. Gear 28 is placed on shaft 19 and is held in place by set screws 30. Gear lubricant is placed on gears 27 and 28. Gear housing 31 is placed over gears 27 and 28 and is screwed to cutter housing 20 by means of screws 32. Slot 36 is provided to accommodate the nail fin and to expose necessary portions of the cutter wheels and the toothed rings 35 which advance the tool.

The second model of the nail fin removal tool is illustrated in FIGS. 7–11. The tool 40 is being powered by an electric drill 41 which is attached to tool 40 by a split circular yoke 42 to which is welded an arm 43. Arm 43 is screwed to tool 40. Nail fin 44 is being removed.

Cutter wheel 45 is attached to the end of shaft 47 by means of set screws 46. Ball bearing 48 is then pressed on to shaft 47. Shaft 47 assembly is then placed into housing 48 with its end projecting through opening 49. Bearing 50 is then pressed on to shaft 47. Bearing 50 occupies opening 49. Drive member 51 is then placed on the end of shaft 47 and is held in place by set screws 51. Member 52 is an anvil that is screwed into housing 48. Cutter wheel 45 has a close clearance with anvil 52 enabling cutter wheel 45 to cut deeply into nail fin 44. Anvil 52 is mounted rotatably on screw 53. Slots 56 and 57 are provided to accommodate the nail fin and to expose the necessary portions of cutter wheel 45, anvil 52, and the toothed ring 58 which advances the tool.

Figure 12:
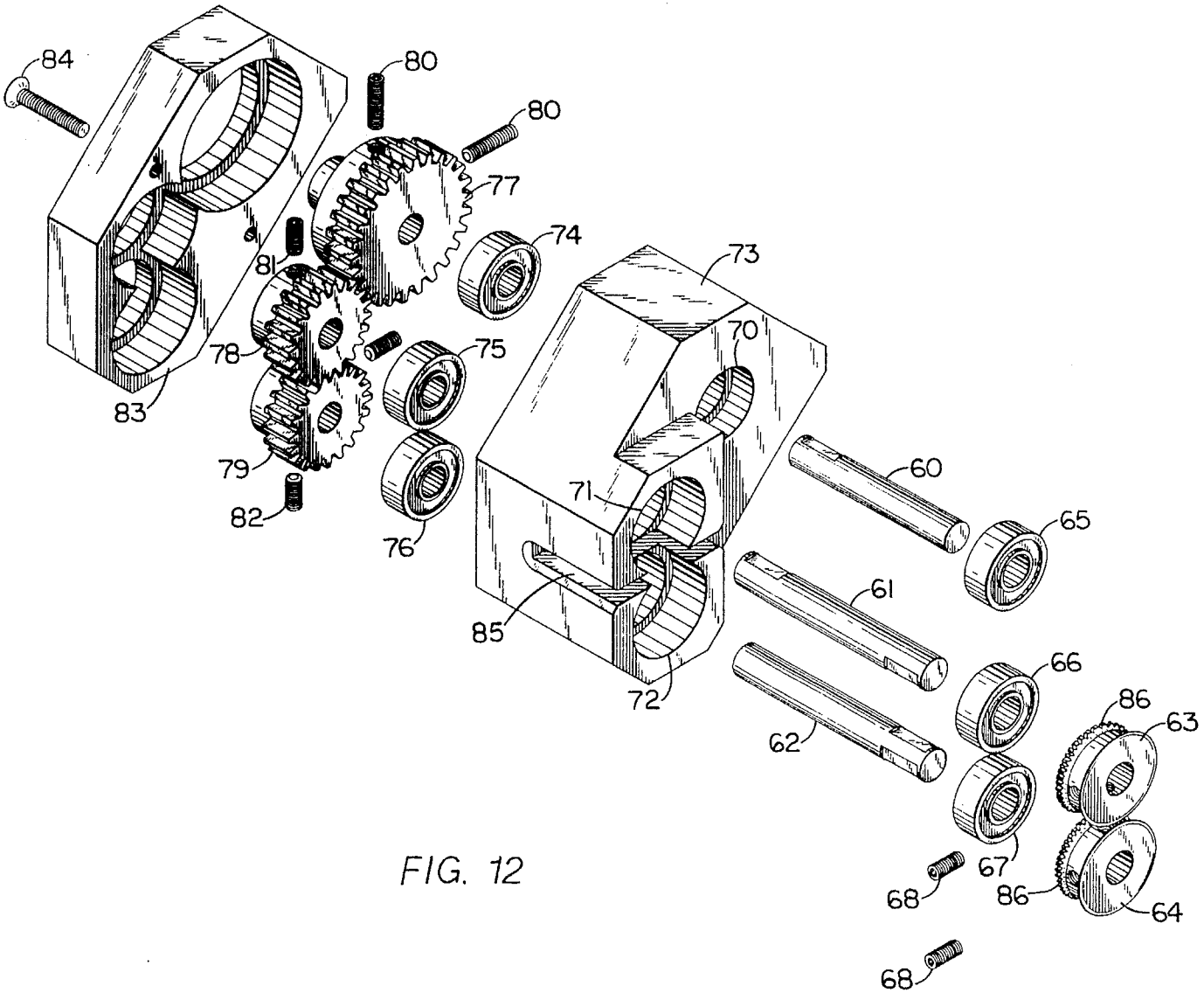
FIG. 12 is an exploded view of a third model of the tool.
Figure 14:
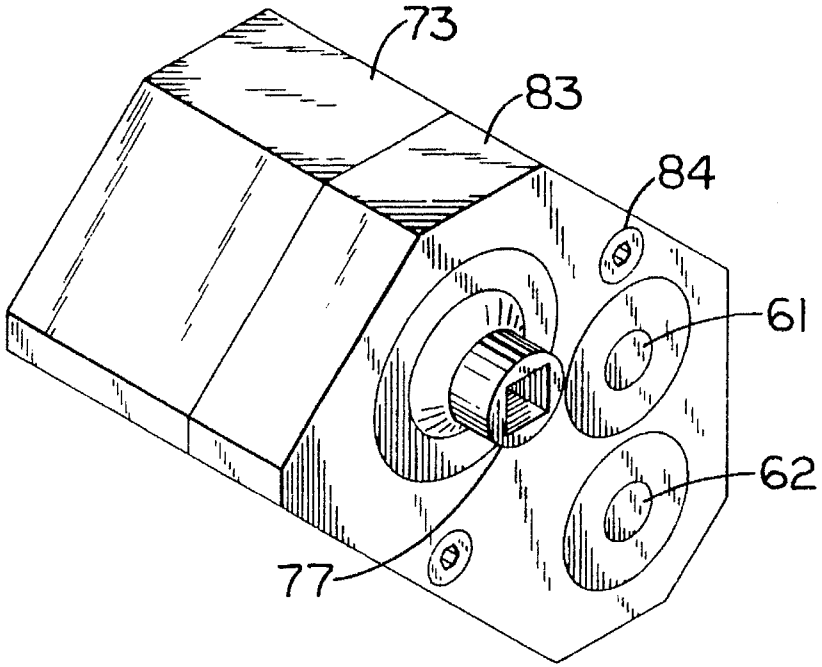
FIG. 14 is a view of the assembled third model of the tool viewed from the driven end.
Figure 13:
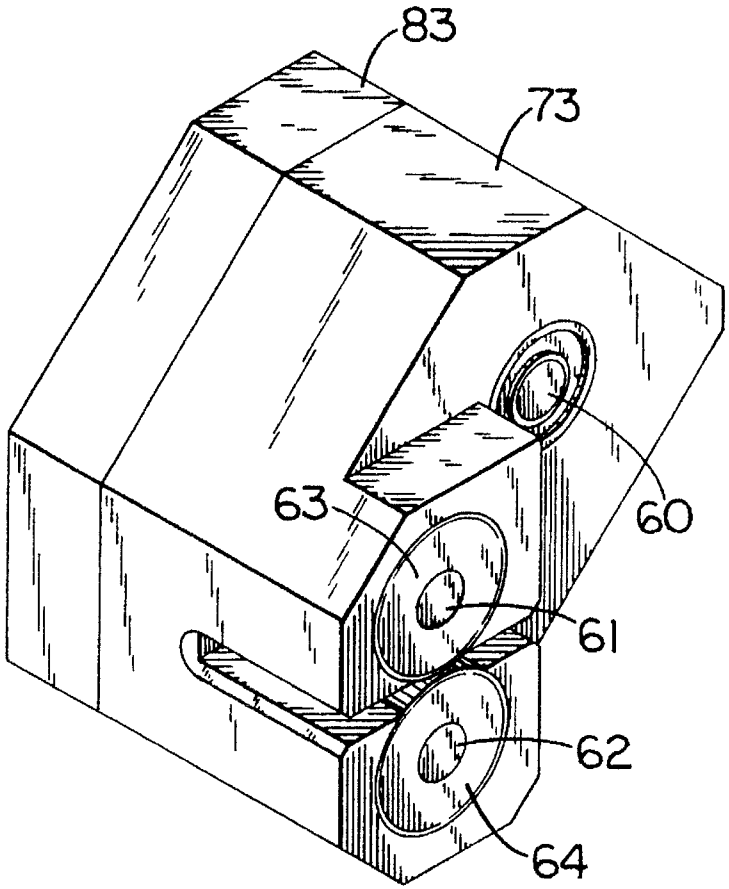
FIG. 13 is a view of the assembled third model of the tool viewed from the cutter end.

The third model of the nail fin removal tool is illustrated in FIGS. 12–14. The drive shaft is 60, and the driven shafts are 61 and 62. Bearing 65 is pressed on to shaft 60. The assembly is then pressed into opening 70 of cutter housing 73. Cutter wheel 63 is mounted on shaft 61 and is held in place by set screw 68. Bearing 66 is then pressed on to shaft 61 and the assembly is pressed into opening 71 in cutter housing 73. Cutter wheel 64 is mounted on shaft 62 and is held in place by set screw 69. Bearing 67 is pressed on to shaft 62 and the assembly is pressed into opening 72 in cutter housing 73. Bearing 74 is pressed on to shaft 60. Bearing 75 is pressed on to shaft 61. Bearing 76 is pressed on to shaft 62. Bearings 74, 75 and 76 occupy recesses in cutter housing 73 (not shown). Driving gear 77 is attached to shaft 60 with set screws 80. Driven gear 78 is attached to shaft 61 by set screw 81, and driven gear 79 is attached to shaft 62 by set screw 82. After packing with gear lubricant, gear housing 83 is placed over gears 77, 78 and 79 and is screwed to cutter housing 73 with screws 84 (only one of which is shown). Slot 85 is provided to accommodate the nail fin and to expose the necessary portions of cutter wheels 63 and 64, and the toothed rings 86 which advance the tool.

There has been described above a hand-held self-propelled tool which will remove a nail fin from a vinyl window frame simply by aligning the tool and applying electric or pneumatic power. The use of hand-held knives is no longer necessary.

I claim:

1. A tool for removing nail fins from vinyl window frames comprising:

a cutter housing having a flat, working surface along one face of the housing to allow the tool to slide along a flat, fin-bearing surface of a conventional vinyl window frame, the housing defining a nail fin receiving slot recessed from the working surface, the receiving slot sized and dimensioned to receive a standard sized nail fin within the slot so that the tool can be moved alone the nail fin with the working surface of the tool remaining in close contact with the fin-bearing surface;

two cutter wheels rotatably mounted within recesses located at the working surface of the housing on opposite sides of the nail fin receiving slot, the cutter wheels having closely opposed curing edges which are co-planar with each other and substantially flush with the working surface, and which extend partially into the nail fin receiving slot, so that the cutting edges can engage and cut the nail fin very close to a base of the nail fin where the nail fin joins the fin-bearing surface of the frame;

a rotating power means for providing rotating power to each of the cutter wheels; and a tool motivating means operatively connected to the cutter wheels and the rotating power means to move the tool along the nail fin while the fin is being cut.

2. The tool of claim 1 wherein the rotating power means is a pneumatic wrench.

3. The tool of claim 1 wherein the rotating power means is an electric hand drill.

4. The tool of claim 1 wherein the motivating means includes a pair of toothed rings recessed within the housing beyond the cutting edges of the cutter wheels, each ring rotatably mounted coaxially with one of the cutter wheels, said rings being smaller in diameter than the cutter wheels, but with the teeth on opposing rings being close enough to engage the nail fin as the rings rotate, so that rotation of the rings moves the tool along the fin.

5. A tool for removing nail fins from vinyl window frames comprising:

a cutter housing having a flat, working surface along one face of the housing to allow the tool to slide along a flat, fin-bearing surface of a conventional vinyl window frame the housing defining a nail fin receiving slot recessed from the working surface, the receiving slot sized and dimensioned to receive a standard sized nail fin within the slot so that the tool can be moved along the nail fin with the working surface of the tool remaining in close contact with the fin-bearing surface;

a single cutter wheel rotatably mounted within a recess located at the working surface of the housing adjacent a first side of the nail fin receiving slot, the cutter wheel having a cutting edge which extends partially into the nail fin receiving slot and is substantially flush with the working surface, so that the cutting edge can engage and cut the nail fin very close to a base of the nail fin where the nail fin joins the fin-bearing surface of the frame;

a rotatable circular anvil mounted within a recess located at the working surface of the housing adjacent a second side of the nail fin receiving slot, opposite the first side of the slot, the anvil having an outermost anvil edge substantially flush with the working surface and substantially coplanar with the cutting edge of the cutter wheel;

a rotating power means for providing rotating power to the cutter wheel; and a tool motivating means operatively connected to the rotating power means to move the tool along the nail fin while the fin is being cut.

6. The tool of claim 5 wherein the rotating power means is a pneumatic wrench.

7. The tool of claim 5 wherein the rotating plower means is an electric hand drill.

8. A tool for removing nail fins from vinyl window frames comprising:

a means for providing rotating power;

a single shaft-mounted cutter wheel;

a rotatable circular anvil co-planar with the cutter wheel and spaced close thereto:

said shaft being supported by anti-friction bearings within the tool:

toothed ring on the cutter wheel to move the tool along the nail fin, said ring being smaller in diameter than the cutter wheel, but of a diameter sufficient to engage the nail fin as the ring rotates to move the tool along the fin; and a slot in the tool to accommodate the nail fin and the cutter wheels as well as a portion of the anvil.

9. A tool for removing nail fins from vinyl window frames comprising:

a means for providing rotating power;

a driving shaft having a gear near one end and a means for engaging the power means;

said shaft being supported within the tool housing by anti-friction bearings below the gear;

a first driven shaft having a gear engaged with the driving shaft gear, and said shaft being supported within the tool housing by anti-friction bearings;

a second driven shaft having a gear engaged with the gear on the first driven shaft, said shaft being supported within the tool housing by anti-friction bearings;

a cutter wheel on the ends of the first and second driven shafts, said ends being at the far end from the gears;

a means on the curer wheels to move the tool along the nail fin; and a slot in the tool housing to accommodate the nail fin and the necessary parts of the cutter wheels as well as the means for moving the tool.

10. The tool of claim 9 wherein the rotating power means is a pneumatic wrench.

11. The tool of claim 9 wherein the rotating power means is an electric hand drill.

12. The tool of claim 9 wherein the means on the curer wheel to move the tool along the nail fin is a toothed ring on the curer wheel, said ring being smaller in diameter than the cutter wheel, but of a diameter sufficient to engage the nail fin as the ring rotates to move the tool along the fin.

13. The tool of claim 5 wherein the motivating means includes a toothed ring recessed within the housing beyond the curing edge of the curer wheel, said ring rotatably mounted coaxially with the cutter wheel, and said ring being smaller in diameter than the cutter wheel, but of a diameter sufficient to engage the nail fin as the ring rotates, so that rotation of the ring moves the tool along the fin.

14. The tool of claim 1, wherein each of said cutter wheels is rotatably mounted on a shaft supported by an anti-friction bearing, each of said shafts being fired with intermeshing gears, and one of said shafts being fired for contact with the rotating power means.

* * * * *

UNITED STATES PATENT AND TRADEMARK OFFICE

CERTIFICATE OF CORRECTION

PATENT NO. : 5,513,435

DATED : MAY 7, 1996

INVENTOR(S) : LARRY BENJAMIN

It is certified that error appears in the above-indentified patent and that said Letters Patent are hereby corrected as shown below:

On the cover page, the inventor's address is missing. change "Klondon" to --Klendon--;

Column 3, line 39, change "alone" to --along--;

line 46, change "curing" to --cutting--;

line 8, after the word "frame" insert --,-- line 47, before the word "toothed" insert --,-- line 3, change "curer" to --cutter--;

line 12, change "curer" to --cutter--;

line 14, change "curer" to --cutter--;

line 3, change "curing" to --cutting--;

line 3, change "curer" to --cutter--;

UNITED STATES PATENT AND TRADEMARK OFFICE

CERTIFICATE OF CORRECTION

PATENT NO. : 5,513,435

DATED : May 7, 1996

INVENTOR(S) : Larry Benjamin

It is certified that error appears in the above-indentified patent and that said Letters Patent is hereby corrected as shown below:

Column 3, line 11, change "fired" to --fitted--; and line 12, change "fired" to --fitter--.

Signed and Sealed this

Twenty-third Day of July, 1996

*Attest:*

*Attesting Officer*

BRUCE LEHMAN

*Commissioner of Patents and Trademarks*